US005492409A

United States Patent [19]

Karlsson et al.

[11] Patent Number: 5,492,409

[45] Date of Patent: Feb. 20, 1996

[54] DEVICE FOR MIXING TWO FLUIDS HAVING DIFFERENT TEMPERATURE

[75] Inventors: Rolf Karlsson; Hernan Tinoco; Mats Henriksson; Anders Lundström, all of Ålvkarleby, Sweden

[73] Assignee: Vattenfall Utveckling AB, Sweden

[21] Appl. No.: 360,739

[22] Filed: Dec. 22, 1994

[30] Foreign Application Priority Data

Jun. 25, 1992 [SE] Sweden ..... 9201959

[51] Int. Cl.[6] ..... B01F 5/06

[52] U.S. Cl. ..... 366/338; 376/277

[58] Field of Search ..... 376/277, 286, 376/292, 352, 377, 389, 399; 366/336, 338, 340; 138/38, 41–45; 137/561 A

[56] References Cited

U.S. PATENT DOCUMENTS 4,043,539 8/1977 Gilmer et al. ..... 366/340

OTHER PUBLICATIONS

Patent Abstracts of Japan, vol. 11, No. 202, C–432, abstract of JP, A, 62–27030, 5 Feb. 1987.

Patent Abstracts of Japan, vol. 8, No. 126, C–228, abstract of JP, A, 59–39331, 3 Mar. 1984.

*Primary Examiner*—Daniel D. Wasil

*Attorney, Agent, or Firm*—Scully, Scott, Murphy & Presser

[57] ABSTRACT

A device for mixing two fluids having different temperatures comprises a connecting branch (6) extending into a main pipe (1) from a secondary pipe (2), said connecting branch having at its end positioned in the main pipe a distribution casing (7) with double annular walls, of which an inner wall (9) defines a channel (10) extending axially and centrally in the main pipe (1), and having apertures which allow a fluid (B) to be conducted into and mixed with the fluid (A) passing through the main pipe. The apertures consist of a plurality of small apertures (11) which are formed in the inner wall (9) of the distribution casing (7) and provide intermixing of the two fluids directly in the channel (10) positioned centrally in the main pipe (1).

1 Claim, 1 Drawing Sheet

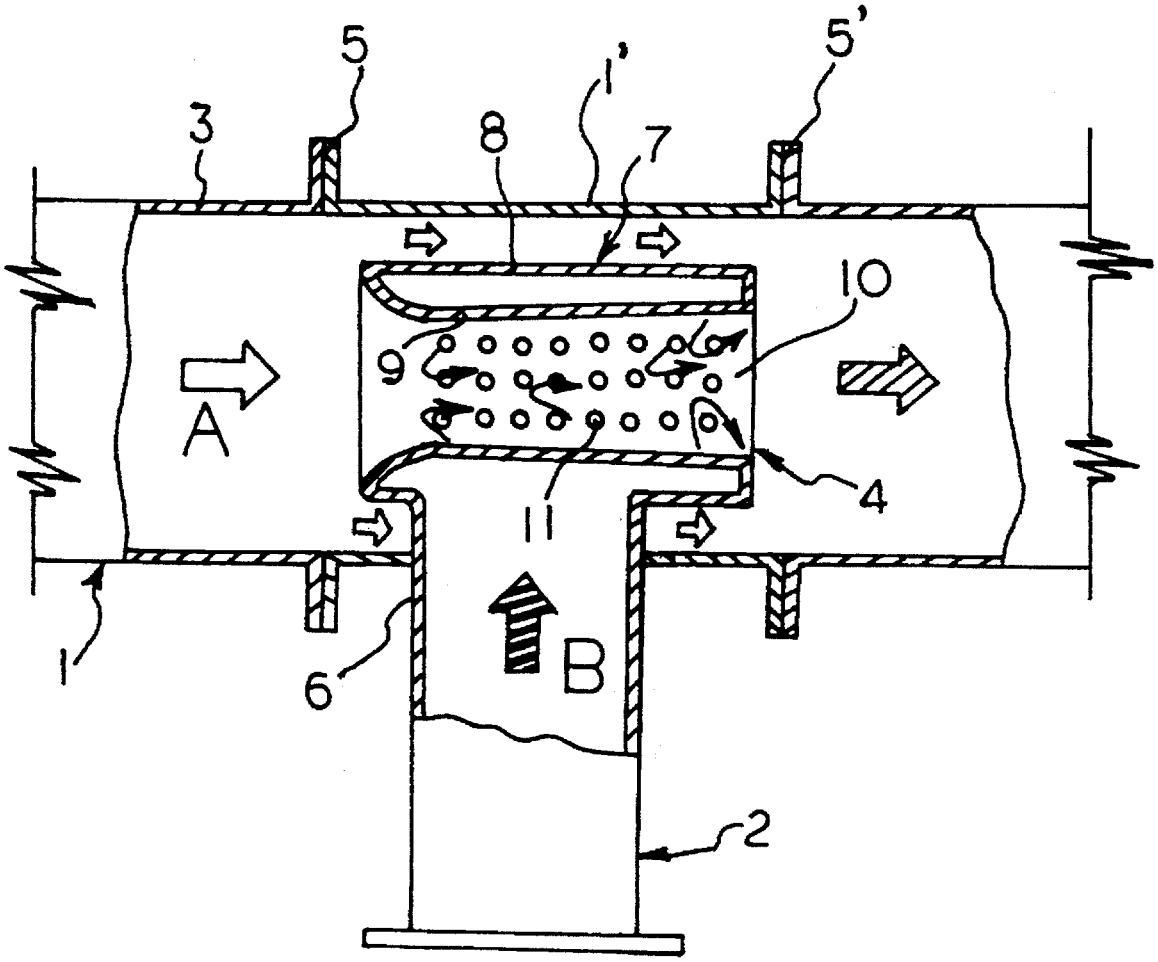
5
5'
1'
3
8
7
10
9
A
4
11
1
6
B
2

DEVICE FOR MIXING TWO FLUIDS HAVING DIFFERENT TEMPERATURE

TECHNICAL FIELD OF THE INVENTION

The present invention relates to a device designed according to the preamble of the claim and intended for mixing two fluids, especially liquids, having different temperatures.

BACKGROUND OF THE INVENTION AND PRIOR-ART-TECHNIQUE

In the systems of water pipes included in nuclear power plants and serving to conduct water to and from, inter alia, the reactor and the condenser, there are a plurality of points at which water having a certain temperature is to be mixed with water having a different temperature. This took previously place in simple T-piece connections or branch pipe points at which an open branch pipe opens directly into an aperture in the circumferential wall of a main pipe. At such branch points, the two water flows meet in an uncontrolled manner during rather intensive vorticity which, inter alia, implies that vortices or streaks of water having a certain, e.g. higher temperature than other streaks of water move back and forth both axially and sideways along the inside of the pipe wall of the main in the area downstream of the branch point. This means that at least the inside of the main pipe is subjected to intermittently repeated variations in temperature, leading to the pipe material, which in practice in most cases is acid-proof steel, alternately being subjected to compressive and tensile stress. This phenomenon, so-called thermal fatigue, shows itself in crack formations in the pipe material. If the differences in temperature between the two intermixed fluids are great, for example 50° C. or more, and the fatigue continues for a long time, the crack formation may advance so far as to jeopardise security. The inclination to form cracks will be especially pronounced in the area of welds which are frequently to be found in the vicinity of the branch point downstream thereof.

For the purpose of at least reducing the above-mentioned problems, attempts have recently been made to mount in the branch point between main and secondary pipes a special mixing device serving to control the mixing process in such a manner that the number of variations in temperature per unit of time along the internal surfaces of the pipe walls is reduced. For such mixing, use has been made of a connecting branch which extends essentially radially into the main pipe from the secondary pipe and in whose cylindrical circumferential surface there are formed a plurality of small perforations through which the water from the secondary pipe flows radially outwards in the form of a corresponding number of jets. In one embodiment, the connecting branch has been formed with perforations of the same size. In other embodiments, experiments have been made with apertures of different size. For example, the perforations of the connecting branch in the area of the main pipe centre have been made larger than the apertures closer to the peripheral wall of the pipe. These experiments have, however, not proved successful in so far as pronounced fluctuations in temperature along the pipe wall surfaces could not be prevented. Especially in variations of the water flows in the two pipes, the force of the jets through the perforations has increased and decreased and, since it was not be possible to prevent individual jets from hitting the inside of the main pipe, the jets will migrate along the surface of the pipe wall and cause variations in temperature in the pipe wall material.

OBJECTS AND FEATURES OF THE INVENTION

The present invention aims at eliminating the deficiencies of prior-art mixing devices of the type described above and providing a device which reduces the risk of thermal fatigue in the walls of the pipes and any welds therein to an absolute minimum. The main object of the invention thus is to provide a mixing device which is capable of mixing a fluid from a secondary pipe in a fluid passing through a main pipe, in an area which is centrally positioned in the main pipe and in such a manner that the mixing process is stable and uniform in the zone downstream of the mixing device, without any pronounced streaks or partial flows of only one fluid migrating back and forth along the inside of the main pipe. A further object of the invention is provide a mixing device which offers minimal resistance to the flow through the main pipe and which therefore causes but negligible pressure drops.

According to the invention these objects are achieved by means of the features defined in the characterising clause of the claim.

FURTHER ELUCIDATION OF PRIOR ART

JP 62-27030 discloses a mixing device designed as an ejector and generally constructed as stated in the preamble of the claim. Like the inventive device, this priorart ejector device comprises a connecting branch which extends into a main pipe and which includes a central duct through which a first fluid may pass in a central partial flow, the duct being surrounded at its outlet end by an annular nozzle-shaped aperture through which a second fluid from a secondary pipe may pass into the main pipe. However, in this prior-art device, the mixing of the two fluids takes place in the area downstream of the duct and not centrally within the duct, as according to the present invention. It should also be noted that the fluids that are intermixed in the device disclosed in JP 62-27030 are not characterised by having different temperatures, and that the object of the device is not at all to solve the crack formation problems which are caused by fluctuations in temperature in the pipe walls.

BRIEF DESCRIPTION OF THE ACCOMPANYING DRAWING

In the drawing, the only Figure is a partial sectional view of two pipes meeting at a branch point at which a mixing device according to the invention is mounted.

DETAILED DESCRIPTION OF A PREFERRED EMBODIMENT OF THE INVENTION

In the drawing, a first pipe or main pipe is generally designated 1, and a secondary pipe is generally designated 2. The actual pipe wall of the pipe 1, which in practice suitably is of cylindrical shape, is designated 3. The pipe 2 suitably extends perpendicularly away from the pipe 1. In the thus formed T-Joint or branch point, there is mounted a mixing device according to the invention, in its entirety designated 4.

In practice, a first fluid (indicated by arrow A) is supplied through the main pipe 1, while a second fluid (arrow B) is supplied through the secondary pipe 2 up to the branch point, to be mixed with the fluid A. The two fluids A, B, which in practice can be liquids, for example in the form of water, have different temperatures when reaching the branch point. When different water flows in a nuclear power plant are involved, the difference in temperature may amount to 50°–100° C., in some cases even more.

The inventive mixing device 4 is mounted in a comparatively short pipe portion 1' which is included as part of the main pipe 1 and fitted with flanges 5, 5'. A connecting branch 6 is permanently welded to the pipe portion 1' and projects a distance beyond the outside of the pipe portion 1'. The connecting branch 6 carries, at its end extending into the portion 1', a distribution casing 7 having double annular walls 8, 9, of which the inner wall 9 defines a channel 10 extending axially and substantially centrally in the pipe portion 1'. The inner wall 9 is formed with a plurality of small apertures 11 which serve as nozzles for discharging the fluid B directly into the channel 10. Part of the flow of the fluid A through the main pipe thus passes through the channel 10 to which the nozzle-shaped apertures 11 are immediately connected, whereby the two fluids A, B will be mixed in a central area inside the pipe portion 1', while preventing individual streaks or jets of the fluid B from contacting and moving back and forth along the inside of the pipe wall 3 of the pipe portion 1' or the main pipe 1.

In the embodiment illustrated in the drawing, the mixing device 4 and the actual pipe portion 1' are manufactured to form a unit which in turn can be mounted in new as well as existing systems of pipes. In existing systems, it is however necessary to cut off not only the secondary pipe 2 but also the main pipe 1 so as to accommodate the unit.

I claim:

1. In a device for mixing two fluids, said device having a connecting branch extending essentially radially into a main pipe, through which a first fluid is supplied from a secondary pipe, through which a second fluid is supplied, the connecting branch having, at one end for positioning in said main pipe, a distribution casing, said casing having double annular walls of which an inner wall defines a channel, said channel extending axially and substantially centrally in said main pipe, said casing including apertures allowing the second fluid to be conducted into and mixed with said first fluid which passes through the main pipe and the channel, the improvement wherein said apertures comprise a plurality of small apertures formed in said inner wall of said distribution casing for providing mixing of said second fluid in said first fluid directly in said channel positioned centrally in said main pipe.

* * * * *

UNITED STATES PATENT AND TRADEMARK OFFICE

CERTIFICATE OF CORRECTION

PATENT NO. : 5,492,409
DATED : February 20, 1996
INVENTOR(S) : Rolf Karlsson, et. al.

It is certified that error appears in the above-indentified patent and that said Letters Patent is hereby corrected as shown below:

Title page, item [22] "Dec. 22, 1994" should read-- Jun. 9, 1993-- and after item [22], insert the following: --[86]$ 371 Date: Jun. 9, 1993--

Column 2, line 28: "priorart" should read --prior-art--

Column 2, line 58: "T-Joint" should read --T-joint--

Signed and Sealed this

Nineteenth Day of November, 1996

Bruce Lehman

*Attest:*

BRUCE LEHMAN

*Attesting Officer*

*Commissioner of Patents and Trademarks*